United States Patent [19]

Hagemeister

[11] Patent Number: 4,515,305

[45] Date of Patent: May 7, 1985

[54] CONNECTION OF THE TUBULAR ENDS OF A HEAT EXCHANGER MATRIX TO THE ASSOCIATED BOTTOM OF THE HEAT EXCHANGER

[75] Inventor: Klaus Hagemeister, Ebenhausen, Fed. Rep. of Germany

[73] Assignee: MTU Motoren-und Turbinen-Union Munchen GmbH, Munich, Fed. Rep. of Germany

[21] Appl. No.: 445,709

[22] Filed: Dec. 1, 1982

[30] Foreign Application Priority Data

Dec. 12, 1981 [DE] Fed. Rep. of Germany ..... 3149285

[51] Int. Cl.[3] ..... B23K 1/18

[52] U.S. Cl. ..... 228/173.2; 228/183; 228/265

[58] Field of Search ..... 228/183, 265, 112, 173 A

[56] References Cited

U.S. PATENT DOCUMENTS 2,545,527 3/1951 Maxwell ..... 228/265 X
4,002,285 1/1977 Wendt ..... 228/265

FOREIGN PATENT DOCUMENTS 572760 11/1958 Belgium .
483878 10/1929 Fed. Rep. of Germany .
2241888 3/1973 Fed. Rep. of Germany ..... 228/265
1414129 11/1975 United Kingdom ..... 228/265

*Primary Examiner*—Kenneth J. Ramsey
*Attorney, Agent, or Firm*—Scully, Scott, Murphy & Presser

[57] ABSTRACT

A connection of the tubular ends of conduits or flow profiles which are associated with a cross-countercurrent matrix of a heat exchanger, and which are internally streamed through by a relatively cool gas (compressed air), to a suitably preperforated heat exchanger bottom of one or more manifolds formed for, respectively, the infeed or discharge of compressed air into or from the applicable heat exchanger matrix. In particular, the invention pertains to a method for the manufacture of such a connection. The respective tubular end is deformed by swaging, forging or similar forming around a mandrel and, subsequent to calibration of the outer contour, is externally coated with a brazing alloy, after which the thus prepared tube end is inserted, together with the mandrel, into the associated opening in the heat exchanger bottom and pressed against the adjacent wall of the opening and along its rim as the mandrel being drawn through, subsequent to which localized heating is employed to produce metallurgical connection between the tube end and the respective portion of the heat exchanger bottom.

19 Claims, 4 Drawing Figures

CONNECTION OF THE TUBULAR ENDS OF A HEAT EXCHANGER MATRIX TO THE ASSOCIATED BOTTOM OF THE HEAT EXCHANGER

BACKGROUND OF THE INVENTION

1. Field of the Invention

The present invention relates to a connection of the tubular ends of conduits or flow profiles which are associated with a cross-countercurrent matrix of a heat exchanger, and which are internally streamed through by a relatively cool gas (compressed air), to a suitably preperforated heat exchanger bottom of one or more manifolds formed for, respectively, the infeed or discharge of compressed air into or from the applicable heat exchanger matrix. In particular, the invention pertains to a method for the manufacture of such a connection.

2. Discussion of the Prior Art

A heat exchanger which is adapted for the utilization of the above-mentioned connection and a method for manufacturing such a connection has become known from German Laid-open Patent Application No. 29 07 810. In this known heat exchanger, there is provided a first compressed-air duct which can convey high-pressure air delivered, for example, from a compressor to a gas turbine engine having such an applicable heat exchanger matrix, in which the high-pressure air is then heated upon the matrix being subjected to the hot gas and will finally stream from the heat exchanger matrix into a second flow conduit which is connected to a suitable consumer, in this instance, to the combustion chamber of the gas turbine engine. For example, in this known heat exchanger the two separate flow conduits can be integrated into a common manifold from which the applicable heat exchanger matrix extends on both sides thereof as a subsequently U-shaped projection.

In connection with a known heat exchanger of that type, consideration must be given to the fact that about 12,000 or more tube connections with the bottom of the associated heat exchanger must be effected in practically a single brazing pass. During the manufacture of such heat exchangers, a brazing operation of such description presents a currently insurmountable risk factor in that relatively large brazing gaps must be provided between the respective tube ends and the associated walls of the holes, inasmuch as a sufficiently large gap is required in order to ensure a troublefree flowing of the brazing alloy, which is herein provided in a liquid molten state. Thus, there is always present the risk that during the process the liquid molten brazing alloy will deposit itself at different locations and that when it has cooled down there is no assurance present that it has filled the brazing gaps along their entire circumference.

Moreover, it has also been shown in practice that relatively large brazing gaps provided for the acceptance of large volumes of brazing alloy may ultimately impair the integrity of such connections. In addition thereto, comparatively thick deposits of brazing alloy in the respective gaps will adversely affect the corrosion resistance.

SUMMARY OF THE INVENTION

Accordingly, it is a primary object of the present invention to eliminate the disadvantages and problems encountered with such connections or with the methods for manufacturing such connections, and to provide a solution through the intermediary of which the respective heat exchanger tubes or flow sections can be fixedly inserted into the applicable heat exchanger bottoms in a simple manner while concurrently affording an optimum temperature resistance and sealing capability.

It is a more specific object of the present invention to provide a connection for the tubular ends of tubes or flow profiled sections which are associated with the cross-countercurrent matrix of a heat exchanger and which are internally streamed about by a relatively cool gas, such as compressed air, with the connection being to a preperforated heat exchanger bottom of at least one manifold formed for the supply or discharge of compressed air into or from the respective heat exchanger matrix, and wherein the respective tubular end is deformed by swaging, forging or similar forming around a mandrel and, subsequent to calibration of the outer contour, is externally coated with a brazing alloy, after which the thus prepared tube end is inserted, together with the mandrel, into the associated opening in the heat exchanger bottom and pressed against the adjacent wall of the opening and along its edge as the mandrel is drawn through, subsequent to which localized heating is employed to produce metallurgical connection between the tube end and the respective portion of the heat exchanger bottom.

Still another object of the present invention is to provide a connection of the above type wherein the associated opening in the heat exchanger bottom, including the circumferential wall of the respective tube end, slightly tapers at the same angle as the tube end so as to close the circumferential gap formed under both radial and axial surface pressure between the associated wall of the opening and the tube end upon the conical tube end being pulled into the respective conical opening through the intermediary of the mandrel and the mandrel collar.

Yet another object of the present invention is to provide a method and apparatus for forming the connection on the tubular ends of tubes of flow profiled sections which are associated with the cross-countercurrent matrix of a heat exchanger.

Thus, drawing the mandrel through and/or withdrawing the mandrel from the respective conduit end, effected in accordance with the method or connection of the present invention, ensures the formation of a satisfactory joint and, concurrently, the brazing of the connection (conduit or hollow flow profile section with the heat exchanger bottom). The drawing through of the mandrel and/or withdrawing thereof from the conduit end produces a form-fitted material compression along the applicable surfaces with the inclusion of the brazing alloy foil or the brazing alloy compound which is applied to the conduit or tube end so that, prior to the final heating operation for the finish manufacture of the connection, the respective gap between the tube end and the wall of the hole in the heat exchanger bottom is appropriately compressed or eliminated so as to practically preclude the brazing alloy from shifting its location.

Furthermore, pursuant to the present invention only extremely small volumes of brazing alloy are required, and correspondingly thin brazing alloy layers, for the respective connections, which will provide an advantage with respect to the respective strength properties as well as regarding corrosion effects, and which will also render itself particularly advantageous with regard to a comparatively low brazing alloy requirement.

BRIEF DESCRIPTION OF THE DRAWINGS

Reference may now be had to the following detailed description of the preferred embodiments of the invention, taken in connection with the accompanying drawings, in which.

DETAILED DESCRIPTION

Figure 1:
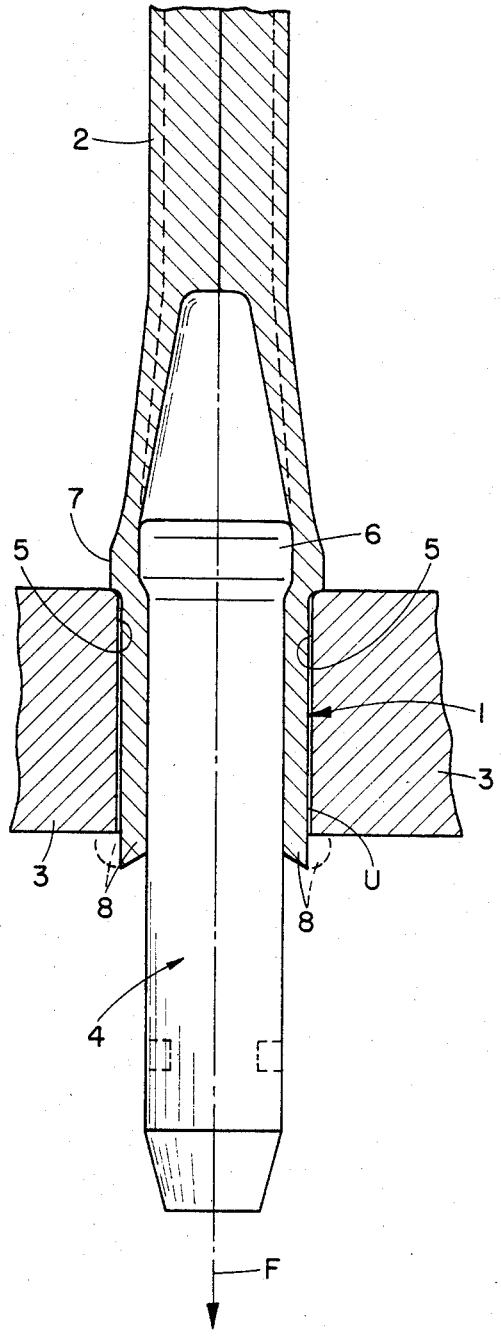
FIG. 1 illustrates a partially sectioned longitudinal view taken along the center plane of a first embodiment of the inventive heat exchanger connection.

Referring to the drawings, FIG. 1 illustrates the connection, or a method for manufacturing the connection, of the tubular end 1 of a hollow flow profile 2 which is associated with the cross-countercurrent matrix of a heat exchanger, with the connection being to a suitably preperforated bottom 3 of the heat exchanger, and in which the tubular end 1 is initially deformed by swaging, forging or other forming over a mandrel 4 and, after calibration of the outer contour, is provided with an external coating of brazing alloy. The tubular end 1 is then inserted, together with the mandrel 4, into an associated opening 5 in the wall of the heat exchanger bottom 3, and upon the mandrel 4 being drawn through the opening, a mandrel collar 6 presses the tube end in the direction of arrow F against the adjoining opening wall 5 and its edge, whereupon localized heating produces a metallurgical connection between the tube end 1 and the respective portion of the heat exchanger bottom. For this purpose, the outer contour of the tube end 1 is first calibrated as accurately as necessary for effectuating the forming process.

Preferably, in the interest of achieving an economical manufacture, the metallurgical connection of all tube ends to the heat exchanger bottom is effected through concurrent heating in a furnaces or the like, in essence, in a single pass.

As is also readily apparent from FIG. 1, the mandrel 4 has a collar 6 on end thereof adjoining the outer wall of the heat exchange bottom 3, with the collar rotationally symmetrically projecting beyond the wall of the mandrel and serving to press the tube end into shape as the mandrel is being drawn through the hole as described hereinabove. Because of the previously effected deformation of the tube end 1 over the mandrel 4, there is concurrently formed a rotationally symmetrical expansion 7 of the tube in conformance with the shape of the collar 6, serving as an opening stop for the tube end 1 besides the flow profile section 2 against the outer wall of the heat exchanger bottom 3.

For the remainder, the external contour of the tube end 1 can be calibrated concurrently with the deformation of the tube end on the mandrel.

The brazing material which is required for the connection or, in effect, the method of producing the connection, can be applied, pursuant to a further aspect of the present invention, to the tube end through, for instance, swaging, forging or rolling in a double-rolling manner at the same time as the tube end is deformed on the mandrel, or concurrently with the calibrating sequence.

In a further aspect of the present invention, the brazing material can be applied on the tube end in the shape of a wound brazing material foil. Hereby, the brazing foil is applied mechanically, for which purpose there can be employed Metglas. Alternatively, the brazing material can also be applied to the applicable tube ends through electrodeposition, spray coating, immersion into a brazing alloy liquid, or through sintering (brazing alloy powder).

The gap U which, on the one hand, is formed between the wall of the opening 5 and, on the other hand, the respective tube end 1, is governed by the requirements of assembly and manufacturing tolerances. This gap U can be cylindrical, as shown in FIG. 1, or it can be slightly conical, tapering in the sense of a reducing cone extending from the upper to the lower end of the opening.

It is further ascertainable from FIG. 1, that the tubular end 1 has a partial section 8 projecting downwardly beyond the lower end of the opening, whereby this axially extending tube section 8 in the path of the final drawing out of the mandrel 4 is at least partially bend sideways over the lower edge of the opening (shown in phantom lines) under the action of the collar 6.

In accordance with FIG. 1, the basic concept thus resides in drawing the mandrel 4 including the collar 6 through the tube section to be joined or through the tube end, so as to impart to the tube end 1 a sudden expansion which causes the closing of the gap U between the wall 5 of the opening and the adjoining circumferential portion of the tube end 1.

A modification which lies within the scope of FIG. 1 but is not shown in the drawing, has a conically extending gap, wherein the gap is already closed, prior to the mandrel and the collar effecting the subsequent forming, having been drawn through the sleeve-like tube end. At an appropriate arrangement and dimensioning of the collar in conformance with the required amount of pressing, there is provided a solution in comparison with FIG. 1, which entails a lower degree of deformation which, in turn, leads to a smaller amount of force and tool wear, as well as accordingly reduced tolerance variations.

The method of manufacturing the connection in accordance with FIG. 1 generally assumes that a countersupport is provided in order to assist in the implementation of the method as a temporary tool, the countersupport acting opposite the direction of arrow F in supporting the connection or the heat exchanger bottom 3 during the manufacturing process, and with the countersupport engaging the axially projecting end 8 from therebelow. This countersupport serves to assist the bending sequence of the axially projecting tube section 8 against the inner wall of the heat exchanger bottom 3 in the vicinity of the opening wall 5.

Figure 2:
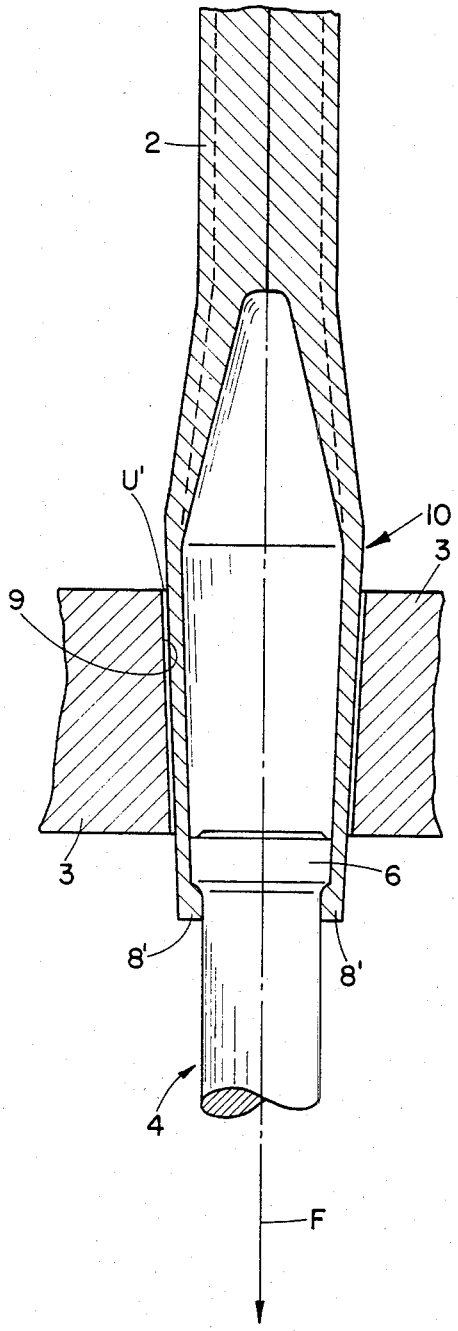
FIG. 2 illustrates a partially sectioned longitudinal view taken along the center plane of a second embodiment of the heat exchanger connection.

Employing essentially the same reference numerals for components identical with those in FIG. 1, FIG. 2 illustrates a modification in which the associated opening 9 in the heat exchanger bottom 3, as well as the circumferential wall of the respective tube end 10, are provided the same angle of taper along their slightly conical contour, and which reducingly tapers towards the inner wall of the heat exchanger bottom 3. In this embodiment, the collar 6 thus provides no plastic deformation of the tube and it always remains in the lowermost position as indicated herein, whereby it is laterally encompassed by the axially projecting tube end portion 8'. In the embodiment of FIG. 2, the conical tube end 10 is, accordingly, drawn with the aid of the mandrel 4 and its collar 6 into the respective conical opening 9, whereby the respective circumferential gap U' is closed under the effects of radial and axial surface pressures between the associated wall of the opening and the tubular end 10. In the embodiment of FIG. 2, the mandrel 4 can, for the remainder, be finally removed from the tube end 10 by bending the axially projecting tube end 8' with the use of suitable tools against the inner wall of the heat exchanger bottom 3.

Figure 3:
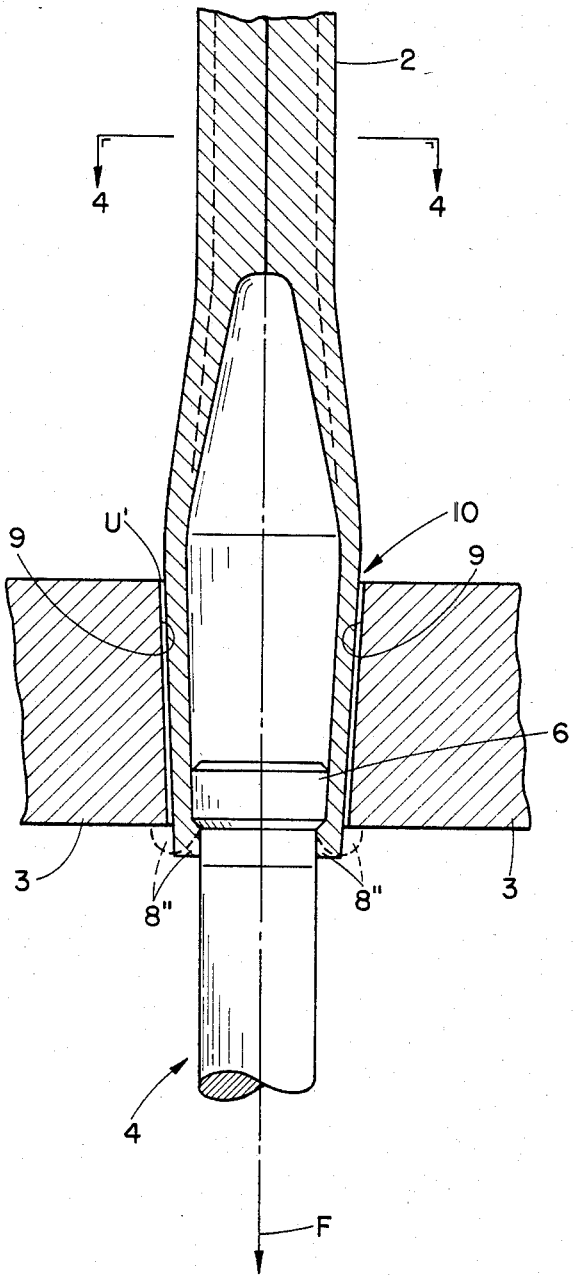
FIG. 3 illustrates a partially sectioned longitudinal view taken along the center plane of a third embodiment of the heat exchanger connection.

Using essentially the same reference numerals as in FIGS. 1 and 2 for similar remaining components, FIG. 3 differs from FIG. 2 largely in that the respective collar 6 of the mandrel 4 still exerts some amount of surface pressure against the connection shortly before it is extracted from the tube end 10, in which, unlike in FIG. 2, the primary object of this arrangement of the mandrel 4 and the collar 6, nevertheless, are here drawn, is to bend the axially projecting tube end 8" against the lower wall of the heat exchanger bottom 3 during the final extraction operation, as is illustrated by the phantom-line contour of the beaded edges.

The inventive concept embraces arrangements in which the tube or tube end 1 or 10, as illustrated in the respective embodiments of FIGS. 1 to 3, has a somewhat higher coefficient of thermal expansion than the material of the heat exchanger bottom 3, whereby during the metallurgical joining sequence, under the action of the prevailing temperature there is provided an additional pressing effect within the gap U or U'.

In a deviation from the illustrated embodiments, the inventive concept also encompasses arrangements in which the tube section which axially projects beyond the lower edge of the opening is bent or beaded against the lower edge of the opening and against the adjacent portions of the inner wall of the heat exchanger before the extraction of the mandrel.

Figure 4:
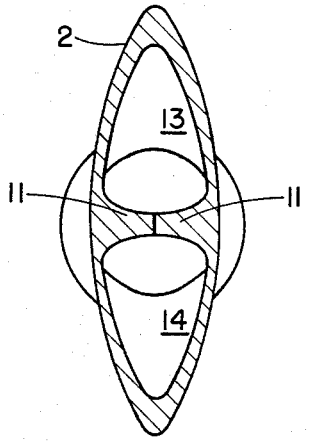
FIG. 4 illustrates a sectional view taken along line IV—IV in FIG. 3.

FIG. 4 finally illustrates, in a sectional view, an arrangement in which oppositely arranged central webs 11 are welded or suitably joined together along their ends, wherein two separate passages 13 and 14 are provided and are pressurized with compressed air during the heat exchanging process.

What is claimed is:

1. In a method for the connection of the tubular ends of tubes or hollow flow sections associated with a cross-countercurrent matrix of a heat exchanger to a suitably preperforated heat exchanger bottom of at least one manifold formed for the infeed or discharge of fluid into or from the respective heat exchanger matrix; the improvement comprising: deforming said tubular end by swaging or forging around an annular section of a mandrel; coating said tubular end with brazing alloy, inserting said tubular end and mandrel into an associated opening in the heat exchanger bottom, and pressing said tubular end against the adjacent wall of the opening and the upper and lower edges thereof and concurrently withdrawing the mandrel, and imparting localized heating to produce a metallurgical bond between the tubular end and the contacting portions of the heat exchanger bottom.

2. A method as claimed in claim 1, wherein the mandrel has a collar adjacent the annular section, and collar being of a larger radius than said annular section, and said pressing of said tubular end against the wall is effected by means of said collar as said mandrel is withdrawn from said opening in the heat exchanger.

3. A method as claimed in claim 2, including forming an annular protrusion adjacent the tubular end by shaping the tubular end over both the collar and annular section of the mandrel, said annular protrusion constituting a stop for said tubular end in said opening.

4. A method as claimed in claim 2, wherein the opening in the heat exchanger bottom and the circumferential wall of the tubular end slightly taper at the same angle as the tubular end wall so as to close a circumferential gap therebetween under both radial and axial surface pressures generated between the associated wall of the opening and the tubular end upon the conical tubular end being drawn into the conical opening by said mandrel and collar.

5. A method as claimed in claim 2, comprising inserting the tubular end into the associated opening in the heat exchanger bottom so that a portion of the tubular end extends axially beyond the lower edge of the opening; and bending said extending portion laterally over the lower edge surface of the opening upon the mandrel being withdrawn in that the mandrel collar provides the bending action.

6. A method as claimed in claim 1, comprising calibrating the outer contour of the tubular end concurrent with the deforming of the tubular end over the mandrel.

7. A method as claimed in claim 1, comprising depositing the brazing alloy on the tubular end by swaging directly prior to the deforming of the tubular end over the mandrel.

8. A method as claimed in claim 1, comprising depositing the brazing alloy on the tubular end in the form of a wound foil.

9. A method as claimed in claim 1, comprising depositing the brazing alloy on the tubular end by electrodeposition.

10. A method as claimed in claim 1, wherein a gap is provided between the wall of the opening and the adjacent wall of the tubular end being insertable therein, said gap conically tapering from the outer wall towards the inner wall of the heat exchanger bottom.

11. A method as claimed in claim 1, wherein the tubular end has a slightly higher coefficient of thermal expansion than the material of the heat exchanger bottom.

12. A method as claimed in claim 1, comprising bending the tubular end beyond the lower edge surface of the opening against the lower edge surface of the opening and against the adjacent portions of the inner wall of the heat exchanger bottom through a countersupport contacting the tubular end.

13. A method as claimed in claim 1, comprising bending the tubular end beyond the lower edge surface of the opening end against the lower edge surface of the opening and against the adjacent portions of the inner wall of the heat exchanger bottom prior to withdrawing of the mandrel from the tubular end.

14. A method as claimed in claim 1, comprising simultaneously effecting a heat-induced metallurgical bonding of a plurality of tubular ends to the heat exchanger bottom in a single pass.

15. A method as claimed in claim 1, comprising depositing the brazing alloy on the tubular end by forging directly prior to the deforming of the tubular end over the mandrel.

16. A method as claimed in claim 1, comprising depositing the brazing alloy on the tubular end by rolling directly prior to the deforming of the tubular end over the mandrel.

17. A method as claimed in claim 1, comprising depositing the brazing alloy on the tubular end by spray coating.

18. A method as claimed in claim 1, comprising depositing the brazing alloy on the tubular end by dipping.

19. A method as claimed in claim 1, comprising depositing the brazing alloy on the tubular end by sintering.

* * * * *